US005528859A

United States Patent [19]

Taylor et al.

[11] Patent Number: 5,528,859

[45] Date of Patent: Jun. 25, 1996

[54] PRESSURE-FIT GATE WITH TOGGLE HANDLE

[75] Inventors: Robert M. Taylor, Orchard Park; Mark E. Gerwitz, West Seneca, both of N.Y.

[73] Assignee: Fisher-Price, Inc., East Aurora, N.Y.

[21] Appl. No.: 335,353

[22] Filed: Nov. 3, 1994

[51] Int. Cl.[6] ..... E06B 3/68

[52] U.S. Cl. ..... 49/55; 49/465; 160/225

[58] Field of Search ..... 49/465, 466, 463, 49/50, 55, 57; 160/225, 224, 216, 222

[56] References Cited

U.S. PATENT DOCUMENTS

| | | | |
|---|---|---|---|
| 903,564 | 11/1908 | Haben . | |
| 1,683,204 | 9/1928 | Mills | 160/225 |
| 2,262,800 | 11/1941 | Farmer | 20/71 |
| 2,559,066 | 7/1951 | Diefenbronn | 20/71 |
| 2,577,034 | 12/1951 | Quinlan | 160/217 |
| 2,581,857 | 1/1952 | Harrison | 160/217 |
| 2,851,746 | 9/1958 | McPhaden | 20/71 |
| 2,896,277 | 7/1959 | Halligan | 20/71 |
| 2,928,146 | 3/1960 | Kuniholm | 20/71 |
| 2,982,353 | 5/1961 | Luger | 160/183 |
| 3,163,205 | 12/1964 | Gottlieb | 160/216 |
| 3,431,966 | 3/1969 | Injeski | 160/225 |
| 3,489,201 | 1/1970 | Curry III et al. | 160/225 |
| 3,680,260 | 8/1972 | Bauer | 49/465 |
| 3,756,469 | 7/1956 | Cattermole et al. | 20/71 |
| 4,149,342 | 4/1979 | Bowers | 49/55 |
| 4,492,263 | 1/1985 | Gebhard | 160/228 |
| 4,607,455 | 8/1986 | Bluem et al. | 49/55 |
| 4,787,174 | 11/1988 | Brown | 49/55 |
| 4,846,246 | 7/1989 | Stern | 160/224 |
| 4,944,117 | 7/1990 | Gebhard et al. | 49/55 |
| 5,052,461 | 10/1991 | Stern | 160/224 |
| 5,272,840 | 12/1993 | Knoedler et al. | 49/463 |
| 5,442,881 | 8/1995 | Asbach et al. | 49/465 |

FOREIGN PATENT DOCUMENTS 494852 7/1953 Canada .

*Primary Examiner*—Philip C. Kannan

*Attorney, Agent, or Firm*—Howrey & Simon; C. Scott Talbot; Leo J. Jennings

[57] ABSTRACT

A gate has a first panel member coupled to a partially overlapping second panel member so that the panels are slidable laterally relative to each other, thus changing the overall width of the gate. An over-center type toggle linkage has a pivot link and a handle link and is operable to laterally expand and contract the lateral distance between the ends. One end of the pivot link is pivotally connected to the first panel and the other end is connected to a medial portion of the handle link. One end of the handle link is pivotally connected to a sliding carriage that slides relative to the second panel and the carriage and handle link end are selectively engagable with the second panel by a releasable engagement mechanism. When the engagement mechanism is disengaged, the panels are free to slide laterally to change the width of the gate. When the engagement mechanism is engaged, operation of the toggle linkage expands or contracts the overall width of the gate. The engagement mechanism may include a slider coupled to a locking knob by a threaded coupling with the knob being located proximate to the pivot axis of the handle link and the carriage.

5 Claims, 14 Drawing Sheets

PRESSURE-FIT GATE WITH TOGGLE HANDLE

BACKGROUND OF THE INVENTION

The invention relates generally to a barrier such as a safety gate that is removably insertable into an opening such as a doorway. Such gates are used, for example, to prevent an infant, a child or a pet from passing through the doorway. More specifically, the invention relates to an adjustable width, pressure-fit gate that is frictionally retained in the doorway opening by application of outward lateral force to the sides of the opening.

This invention is an improvement over the type of gate disclosed in the U.S. patent application of Carl M. Stern being filed on even date and entitled PRESSURE FIT GATE. In the type of gate disclosed in that application, a first panel member is coupled to a partially overlapping second panel member so that the panels are slidable laterally relative to each other, thus changing the overall width of the gate. A carriage member is slidably mounted on the second panel for lateral movement relative to the second panel and a displacing mechanism is coupled with the carriage member and the second panel and is selectively operable to laterally displace the carriage relative to the second panel. An engagement mechanism is connected to the carriage for selectively engaging with and nonengaging with the first panel. When the engaging mechanism is non-engaged lateral movement of the carriage member with respect to the second panel does not cause relative lateral movement between the first panel and the second panel, and when the engaging mechanism is engaged lateral movement of the carriage member causes corresponding relative lateral movement between the first panel and the second panel. The expansion mechanism may include an over-center linkage.

SUMMARY OF THE INVENTION

In one aspect, the present invention provides a gate having a first panel member coupled to a partially overlapping second panel member so that the panels are slidable laterally relative to each other, thus changing the overall width of the gate. An over-center type toggle linkage has a pivot link and a handle link and is operable to laterally expand and contract the lateral distance between the ends. One end of the pivot link is pivotally connected to the first panel and the other end is connected to a medial portion of the handle link. One end of the handle link is pivotally connected to a sliding carriage that slides relative to the second panel and the carriage and handle link end are selectively engagable with the second panel by a releasable engagement mechanism. When the engagement mechanism is disengaged, the panels are free to slide laterally to change the width of the gate. When the engagement mechanism is engaged, operation of the toggle linkage expands or contracts the overall width of the gate.

In another aspect of the invention, the engagement mechanism comprises a slider coupled to a locking knob by a threaded coupling with the knob being located proximate to the pivot axis of the handle link and the carriage.

DETAILED DESCRIPTION

Figure 1A:
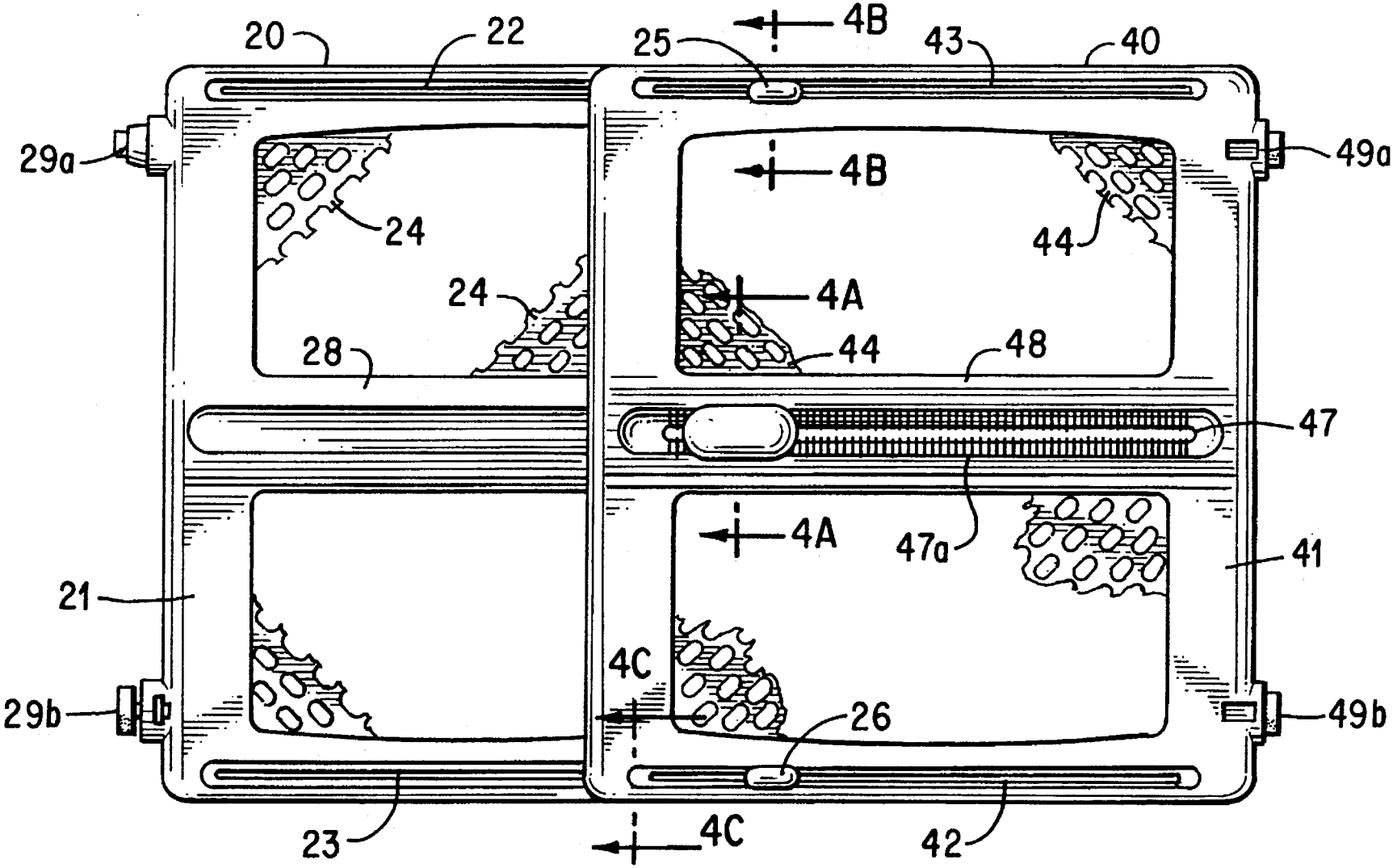
FIG. 1A is a front elevation view of a preferred embodiment of the gate of the present invention.
Figure 1B:
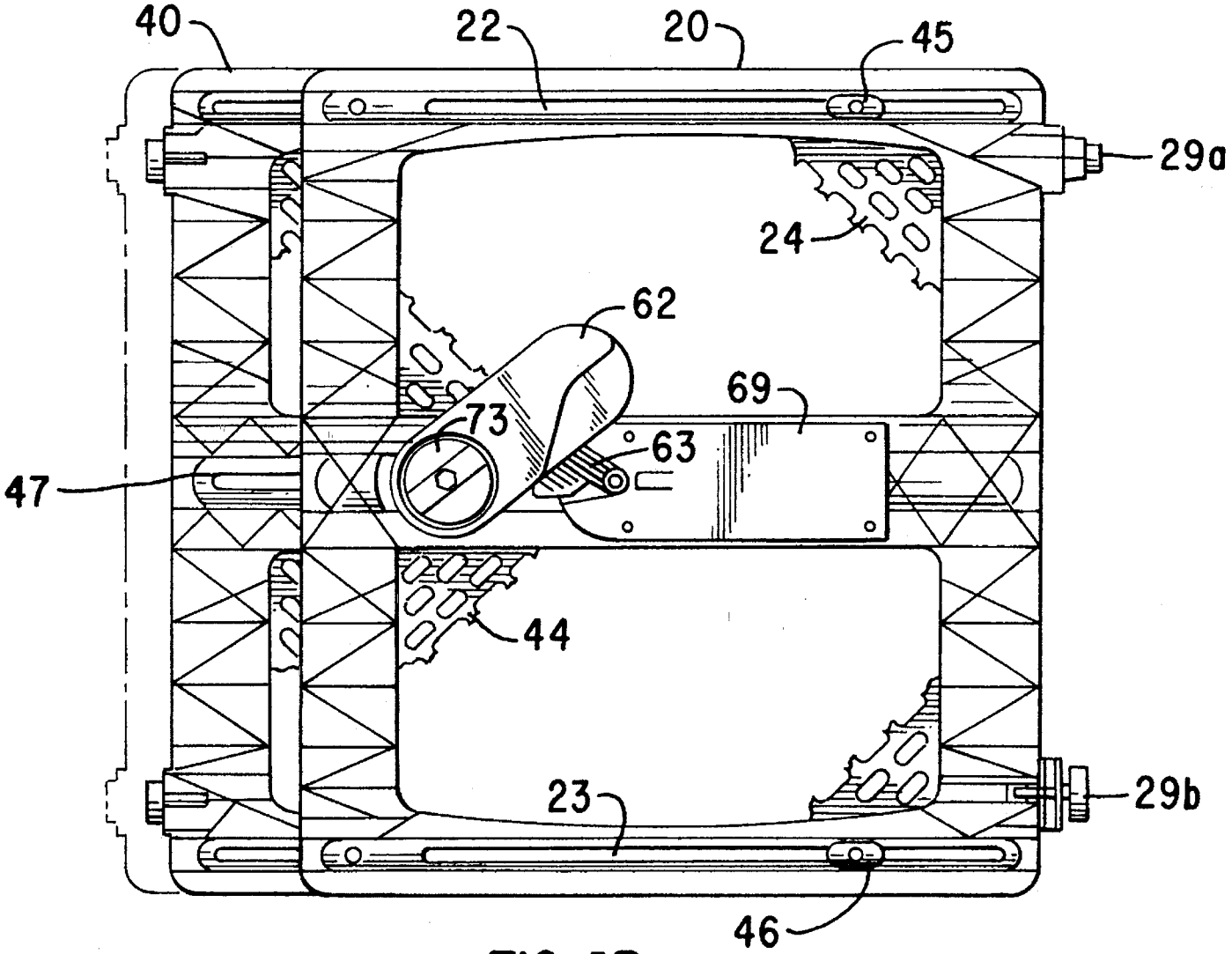
FIG. 1B is a rear elevation view of the gate in an unexpanded position.

Reference will now be made in detail to presently preferred embodiments of the invention, examples of which are illustrated in the accompanying drawings. As depicted in FIGS. 1 through 5, the apparatus generally includes a rear panel 20 that is coupled to a partially overlapping front panel 40 so that the panels are slidable laterally relative to each other, thus changing the overall width of the gate. An overcenter type toggle linkage 60 has two links and is operable via a handle portion of one of the links to laterally expand and contract the lateral distance between the distal ends of the links. One end of the toggle linkage 60 is connected to the rear panel 20, and the other end of the toggle linkage 60 is selectively engagable with the front panel 40 by a releasable engagement mechanism 70.

The engagement mechanism 70 is disengaged or released to permit adjustment of the overall unexpanded width of the gate. When the engagement mechanism 70 is released, the panels 20 and 40 remain freely slidable relative to each other, and permit a range of adjustment of the overall width of the gate apparatus.

When the engagement mechanism 70 is engaged, the toggle linkage 60 is operable to displace the rear panel 20 and front panel 40 relative to each other by a predetermined distance to expand the gate and apply an outward lateral force to the sides of an opening to frictionally retain the gate in the opening. This is accomplished because when the engagement mechanism 70 is engaged with the front panel 40, expanding the toggle linkage 60 will laterally displace the panels 20 and 40 relative to each other, thereby expanding the overall gate width. Conversely, contracting the toggle linkage 60 will displace the panels 20 and 40 relative to each other to reduce the overall gate width.

The preferred embodiment is described in more detail below. The rear panel 20 is slidably coupled to the front panel 40 by a pair of rear sliders 45, 46 attached to the front panel 40 that pass through and slide along slots 22, 23 in the rear panel 20. Similarly, a pair of front sliders 25, 26 attached to the rear panel 20 slide in slots 42, 43 in the front panel 40. This slider and slot arrangement provides for a wide range of lateral movement of the gate panels 20 and 40 relative to each other to facilitate adjustment of the unexpanded (and hence also the expanded) width of the gate. The rear panel 20 is provided with upper and lower bumpers 29*a* and 29*b* which have a rubber or other suitable gripping surface for contacting the side of the opening to be blocked. Similarly, the front panel 40 includes upper and lower bumpers 49*a* and 49*b*. One or more of these bumpers may be horizontally adjustable to accommodate out-of-square or uneven openings.

The front panel 40 includes a generally rectangular perimeter frame 41 and a center ridge 48. Mesh panels 44 are provided as shown within the perimeter frame 41. The rear panel 20 includes a frame 21 similar to that of the front panel 40 including a center ridge 28 and mesh panels 24. It will be appreciated that the panels 20 and 40 may take any of the many known panel forms such as those suitable for use in security gates used with infants, children or pets. By way of example only, the gate panels may be each comprise integral plastic molded panels as shown, or alternatively the gate panels may each comprise a rectangular wood perimeter frame with a wire or plastic grid material inside the frame.

The engagement mechanism locking slider 71 is attached by a threaded rod 72 to a locking knob 73. The rod 72 passes through a center slot 47 in the front panel 40 and a center slot 27 in the rear panel 20, and also passes through a carriage 61. The threaded rod 72 and slider 71 are capable of sliding along the slot 47 when the knob 73 is loosened. However, when the knob 73 is tightened, the slider 71 is urged against the front edges of the slot 47 and contacts and frictionally engages the front panel 40. The inner side of the slider 71 has teeth 71*a* that mate with teeth 47*a* on the edges of the slot 47 when the locking knob 73 is tightened. Thus, when the knob 73 is loosened, the panels 20 and 40 are free to slide relative each other, and when the knob 73 is tightened, the slider 71, rod 72, knob 73 and carriage 61 are fixed relative to the front panel 40. As shown in FIGS. 9A through 9D, the slider 71 may have a decorative cover 71*b* mounted to this outer side to improve its appearance.

Figure 2:
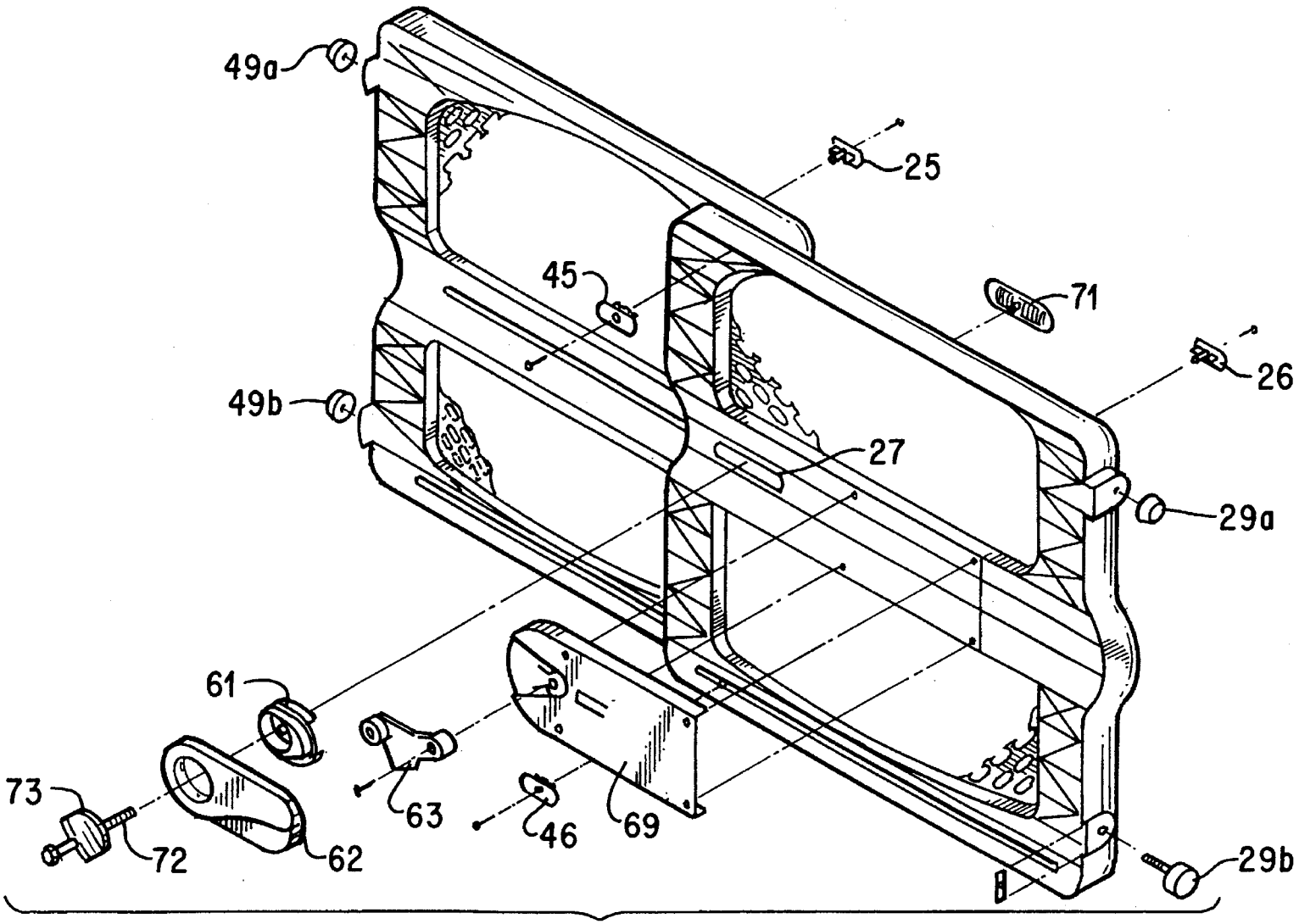
FIG. 2 is an exploded view of the gate.
Figure 3A:
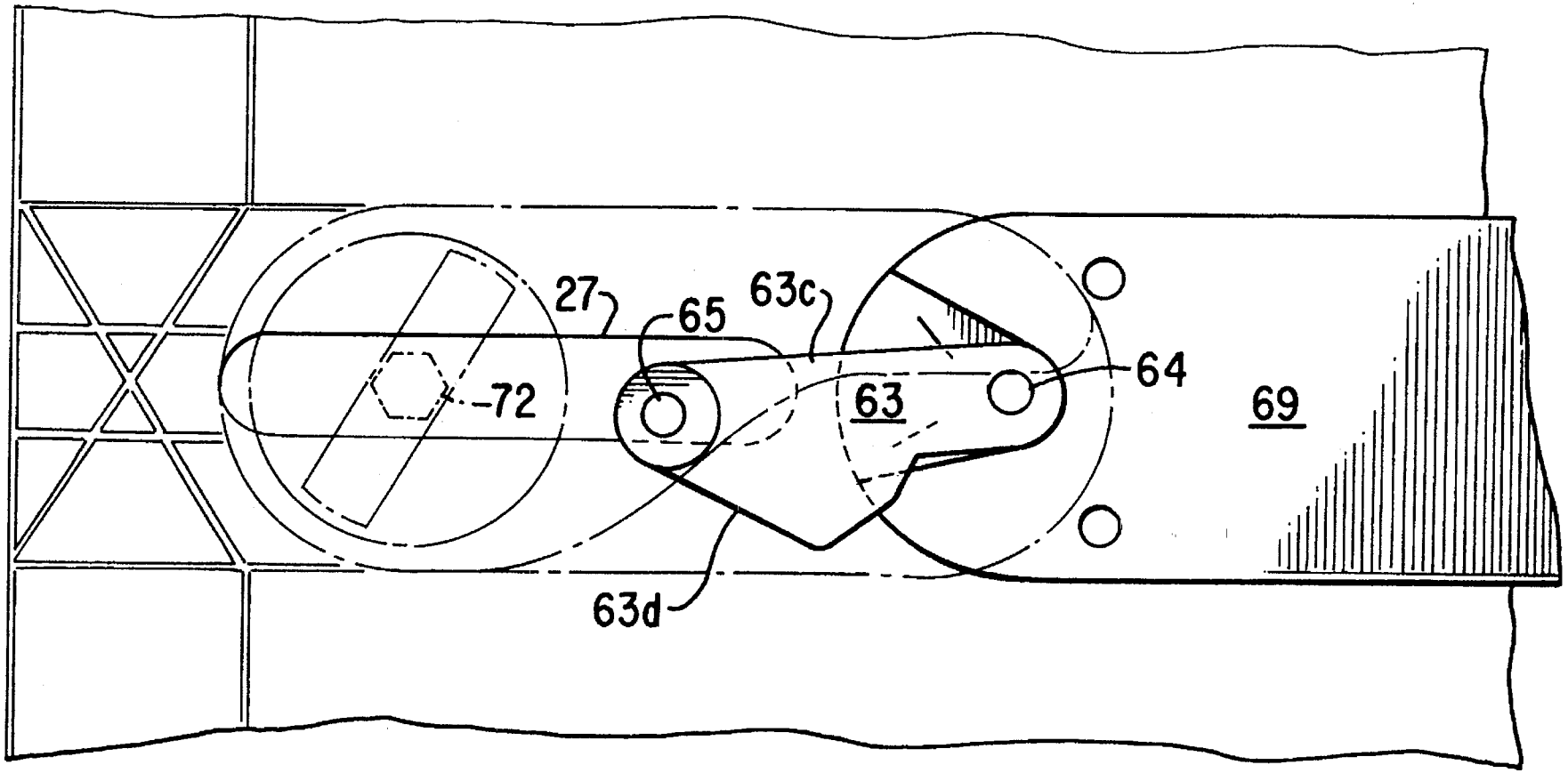
FIG. 3A is a partial rear elevation view showing the linkage in the expanded position.
Figure 3B:
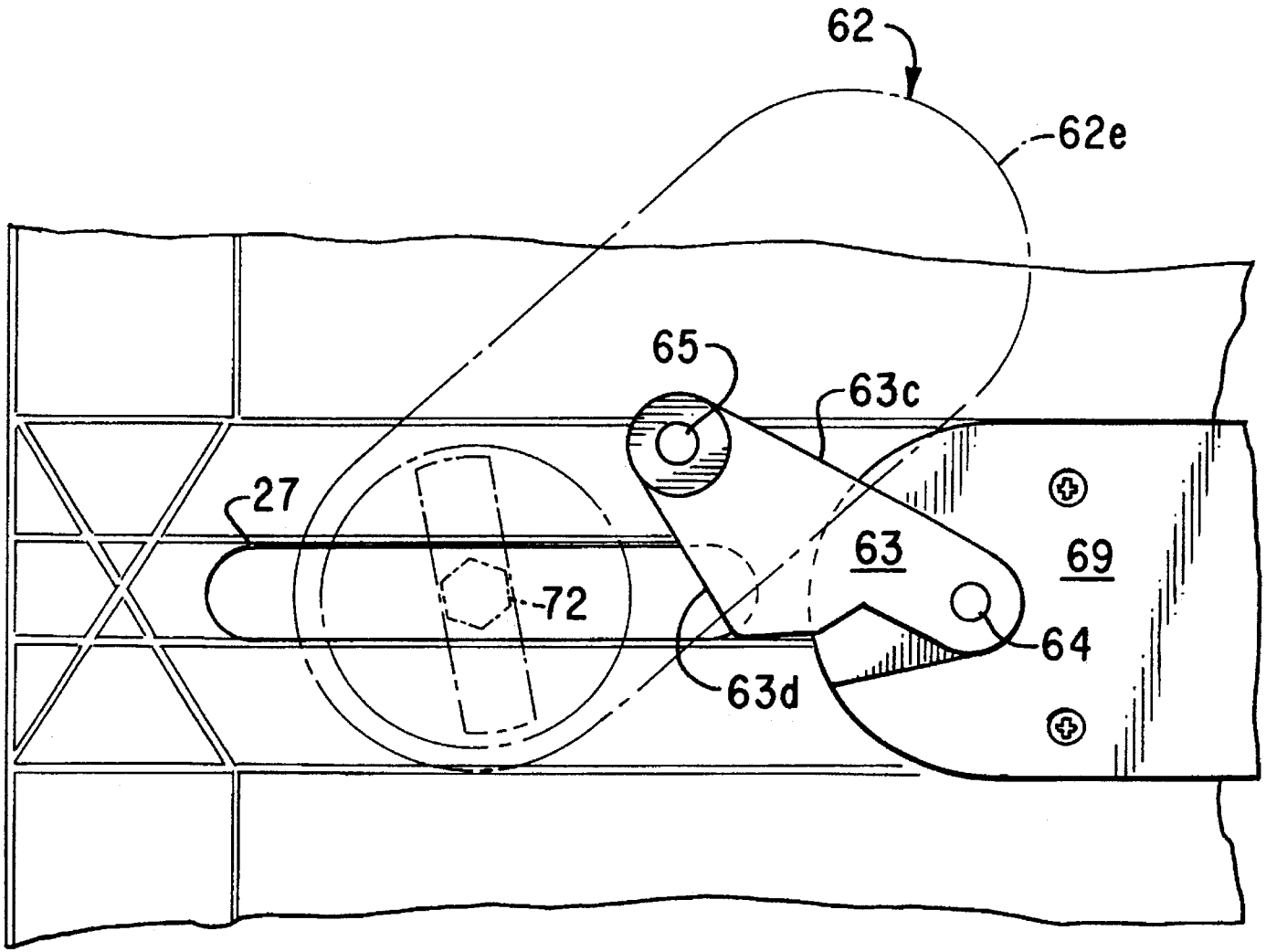
FIG. 3B is a partial rear elevation view showing the linkage in the unexpanded position.

Referring particularly to FIGS. 2, 3A, 3B, the carriage 61 is slidably mounted for lateral motion relative to the rear panel 20 along the slot 27 via a portion 61*b* that fits slidably in the slot 27 and is capable of such sliding even when the knob 73 is tightened. The over-center linkage 60 includes a handle link 62 and a pivot link 63. The handle link 62 is pivotally coupled at one end to the carriage 61 as follows—the handle link 62 has a circular indentation 62*a* on its rear surface into which fits a mating circular projection 61*a* on the front of the carriage 61 so as to permit the handle link 62 to rotate about the axis of the edges (which is also the axis of the rod 72) relative to the carriage 61. The range of rotation of the handle link 62 about the that axis relative to the carriage 61 is limited at the fully raised position (shown in FIG. 3B) by contact between an edge 62*d* on the handle link 62 and an edge of 63*b* on the pivot link 63. The range of rotation at the fully depressed position (shown in FIG. 3A) is limited by contact between an edge 62*c* on the handle link 62 and an edge 63*c* the pivot link 63.

The handle link 62 at a medial portion thereof is pivotally connected to the end of pivot link 63 by a pin 65. A base link member 69 is fixedly mounted to rear gate panel 20, and the end of the pivot link 63 away from the handle link 62 is pivotally connected to the rear panel 20 via the base link 69 by a pin 64. The handle link 62 may feature a hand grip indentation 62*b* to facilitate lifting the handle link 62. Lifting on the handle link 62 raises the free end 62*e* of the handle link 62 and thus rotates the handle link 62 and the pivot link 63 upwards into the position shown in FIG. 3B, and accordingly the over-center linkage 60 is foreshortened laterally—that is the lateral distance between the pin 64 and the pivot axis of the handle link 62 about the carriage 61 (i.e. the threaded rod 72) is reduced.

Since the pivot link 63 is effectively attached to the rear panel 20 by the pin 64 and the base link 69, this lateral foreshortening of the over-center linkage 60 moves the carriage 61 laterally inward toward the linkage 60. If the knob 73 is not tightened, the front panel 40 is not affected and remains free to slide laterally relative to the rear panel 20. However, if the handle link 62 is raised while the knob 73 is tightened, the front panel 40 will be moved inward laterally relative to the rear panel 20 by a distance corresponding to the inward lateral movement of the carriage 61 into the configuration shown in FIG. 3B. Then, depressing the handle link 62 causes the front panel 40 to move outward laterally relative the rear panel 20 into the configuration shown in FIG. 3A.

Figure 3C:
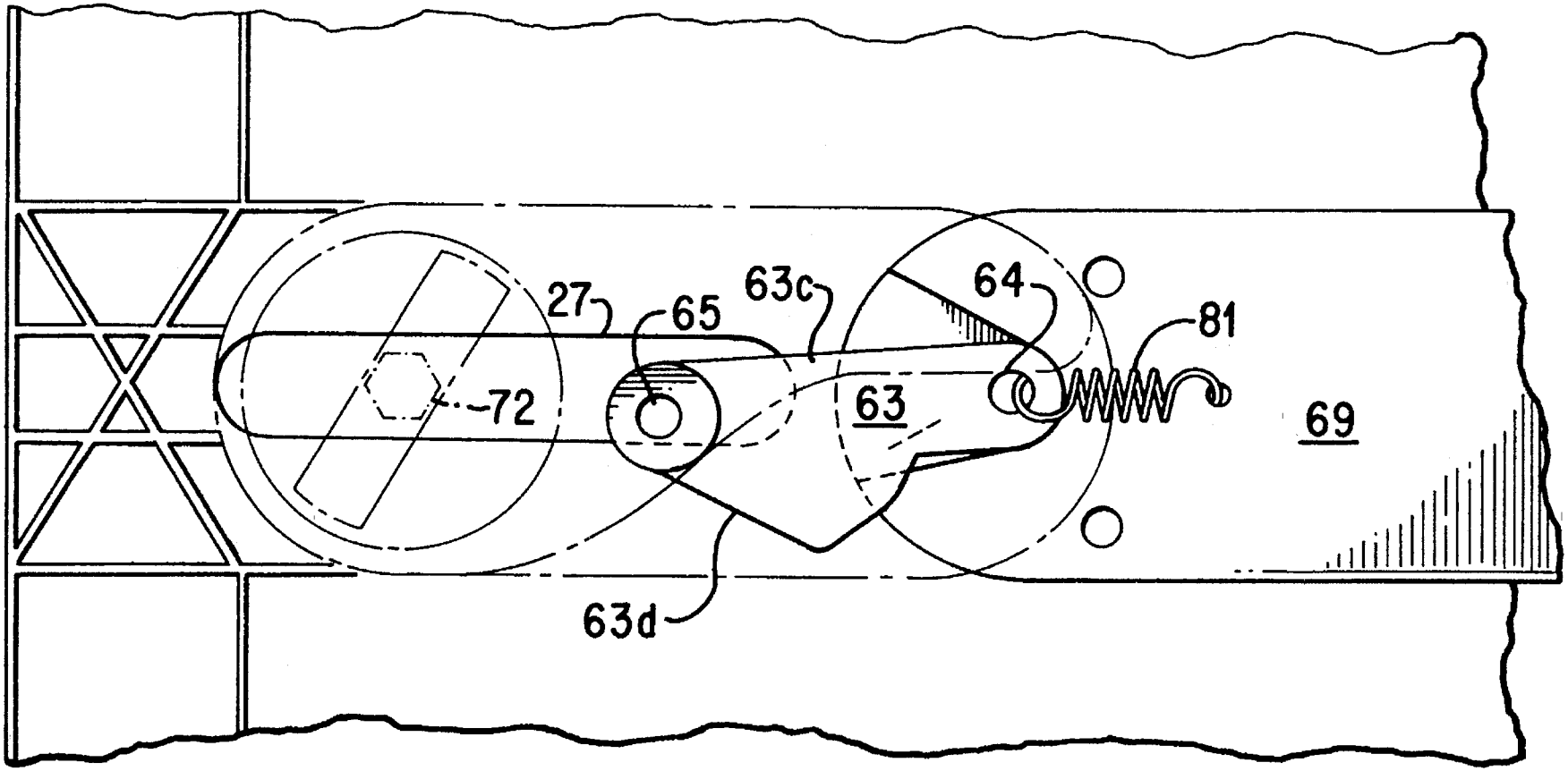
FIG. 3C is partial rear elevation view of an alternative embodiment of the invention.
Figure 4A:
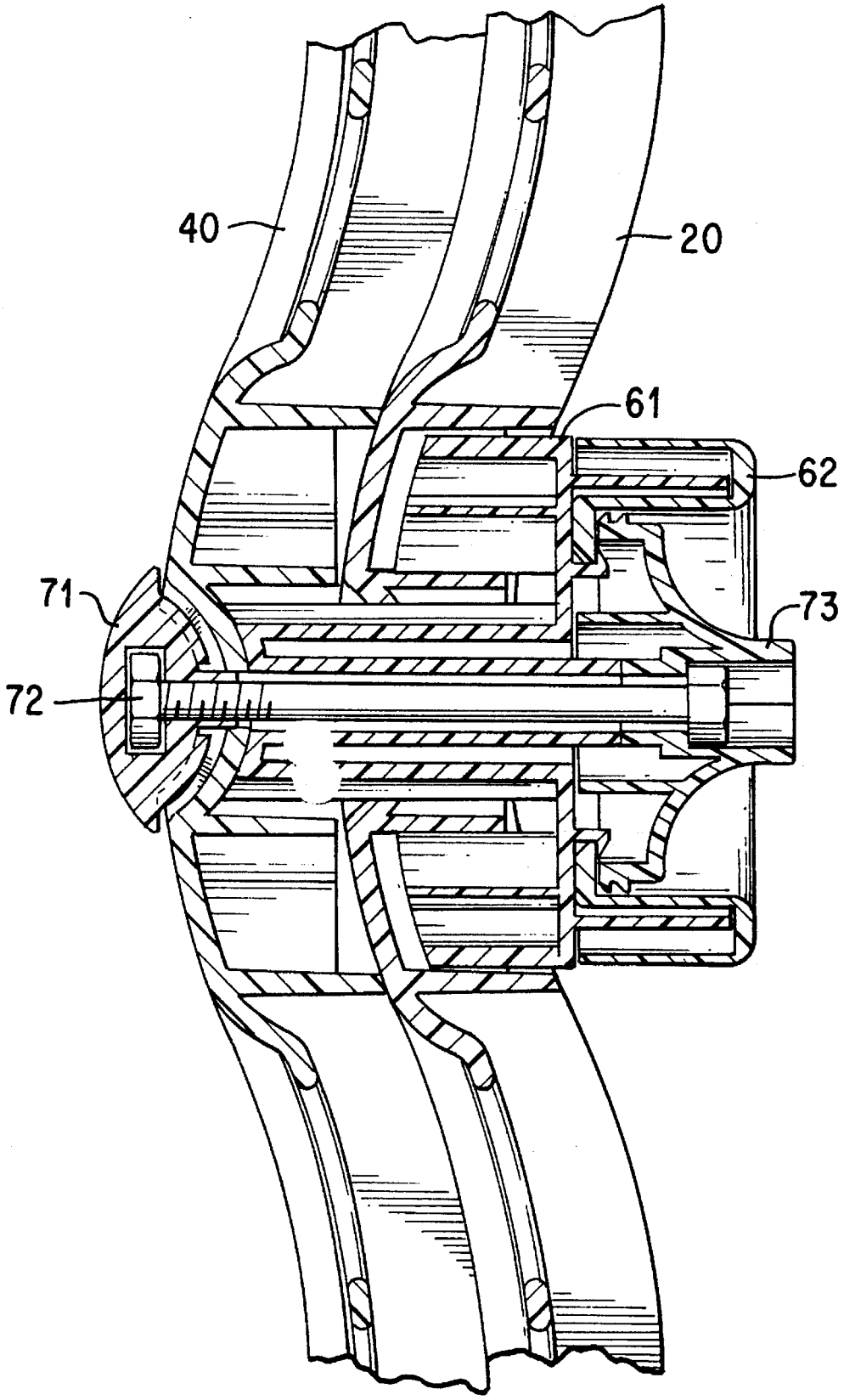
FIGS. 4A, 4B and 4C are partial cross sectional views taken along the lines indicated in FIG. 1A.
Figure 4B:
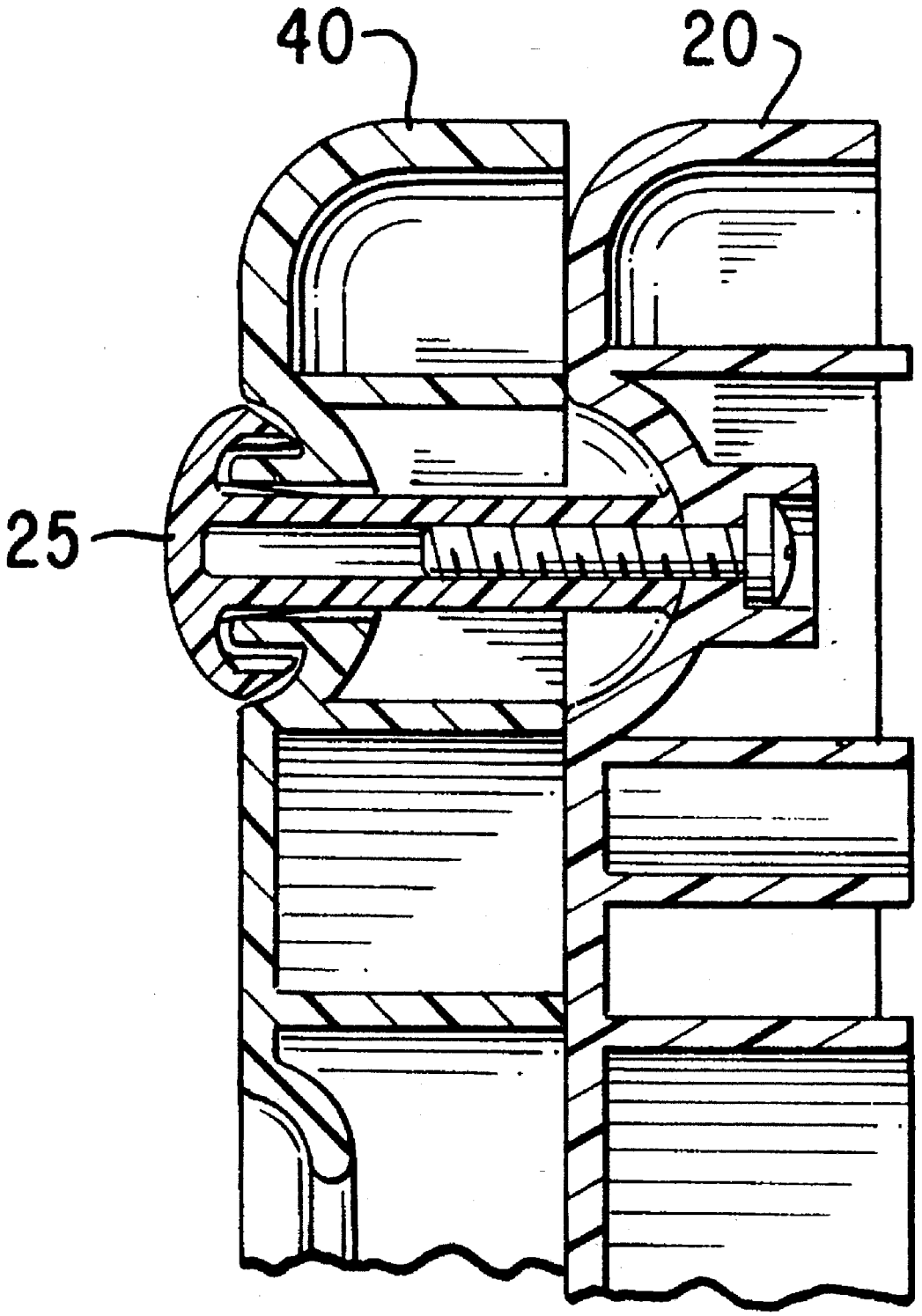
Figure 4C:
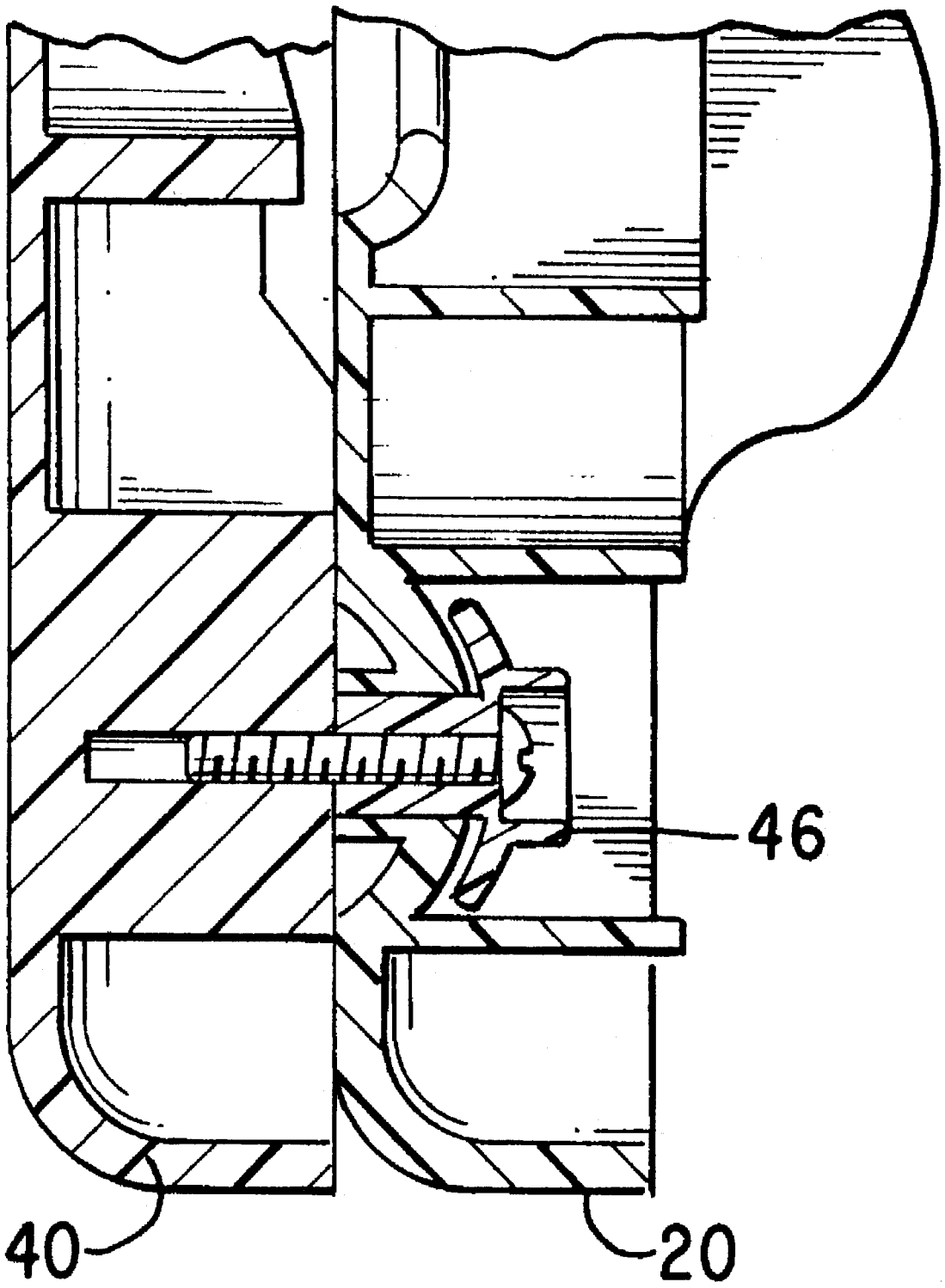
Figure 5A:
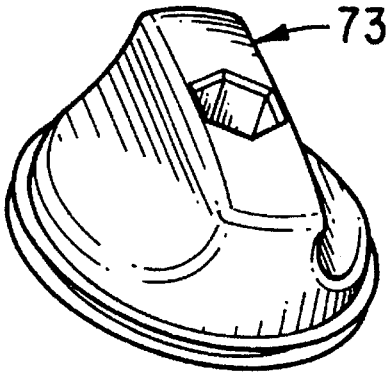
FIGS. 5A and 5B are perspective views of the locking knob.
Figure 5B:
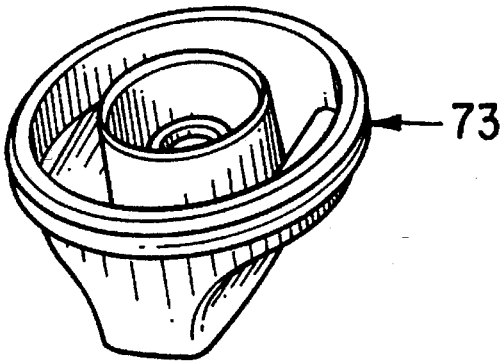
Figure 6A:
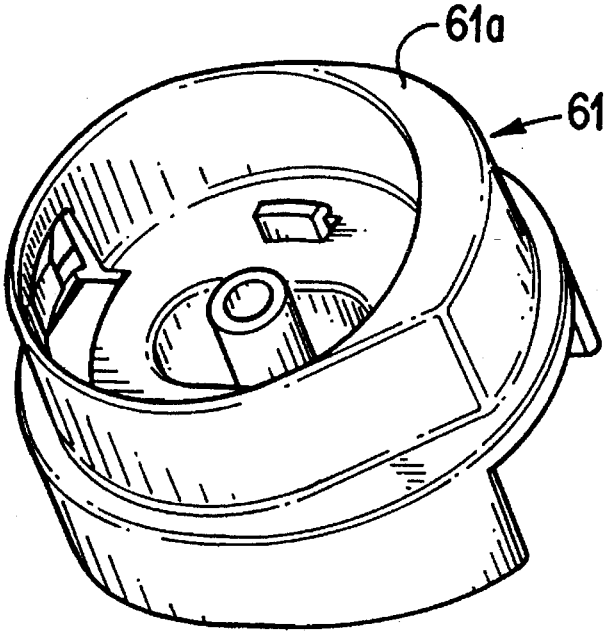
FIGS. 6A, 6B, and 6C are perspective views of the carriage.
Figure 6B:
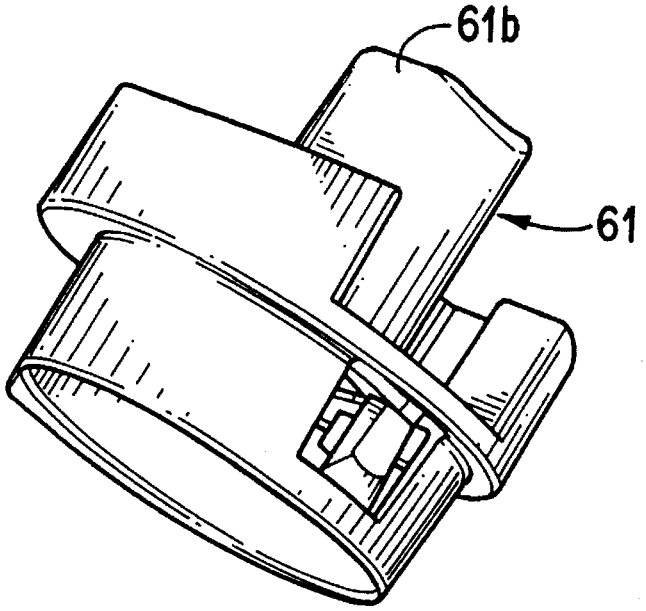
Figure 6C:
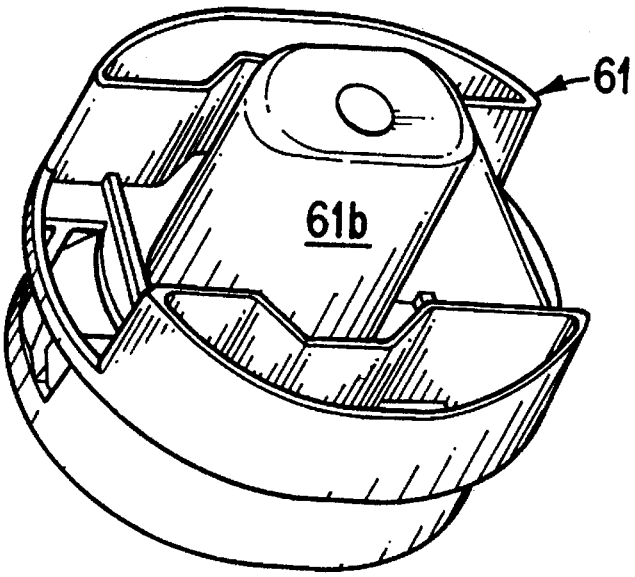
Figure 7A:
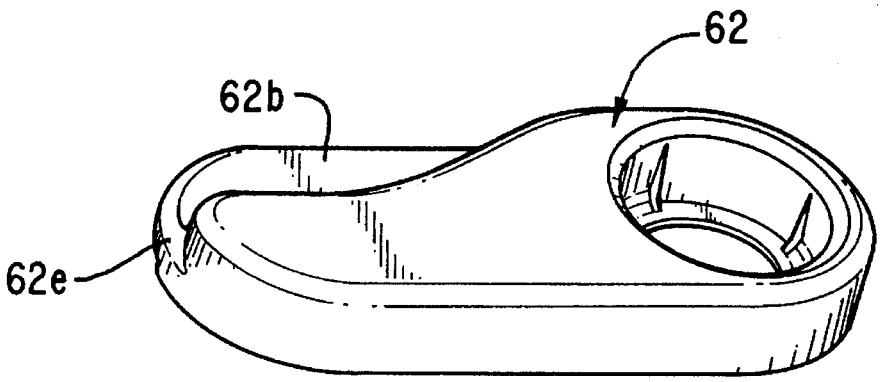
FIGS. 7A and 7B are perspective views of the handle link.
Figure 7B:
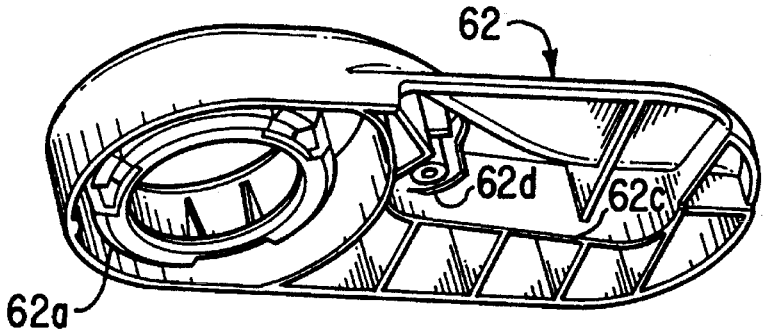
Figure 8A:
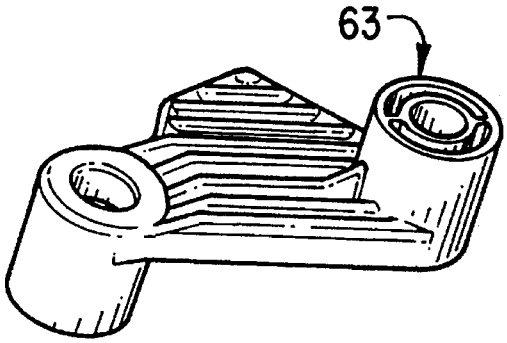
FIGS. 8A and 8B are perspective views of the pivot link.
Figure 8B:
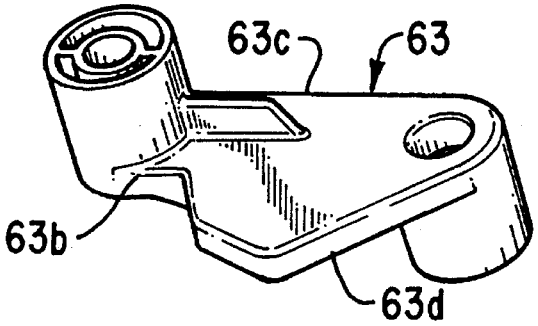
Figure 9A:
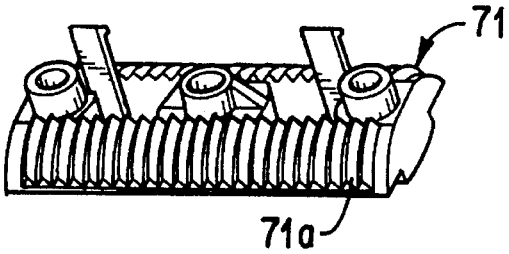
FIGS. 9A, 9B, 9C, and 9D are perspective views of the locking slider.
Figure 9B:
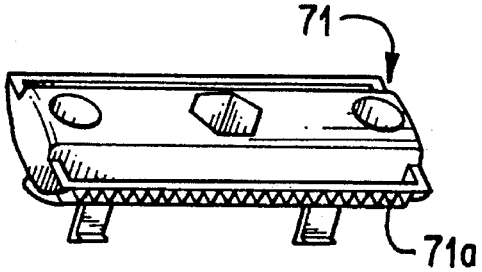
Figure 9C:
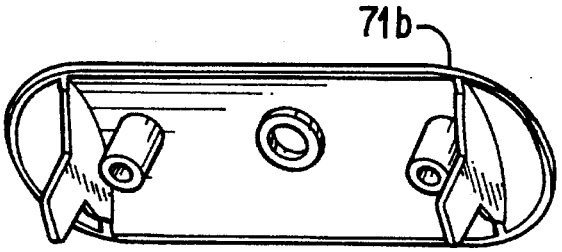
Figure 9D:
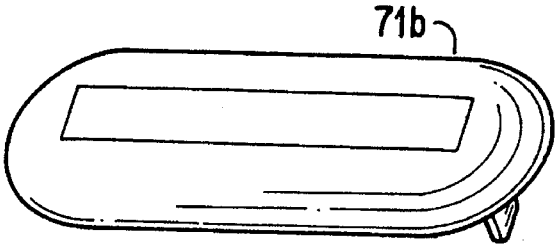
Figure 10A:
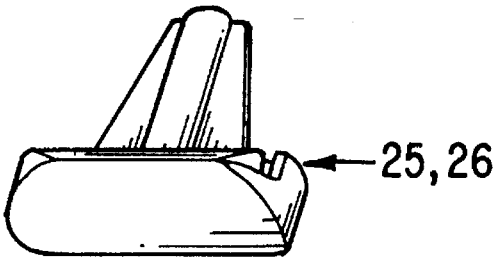
FIGS. 10A and 10B are perspective views of the front sliders.
Figure 10B:
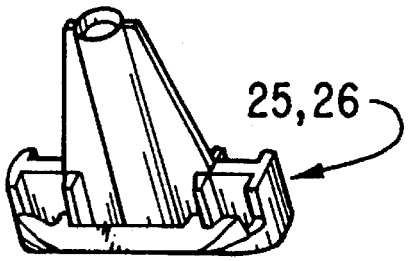
Figure 11A:
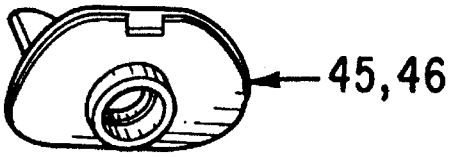
FIGS. 11A and 11B are perspective views of the rear sliders.
Figure 11B:
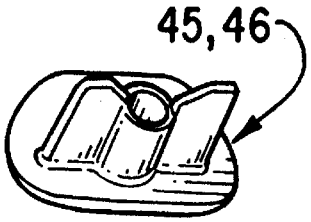

In an alternative embodiment shown schematically in FIG. 3C, a spring 81 or other resilient member is provided to permit some lateral travel of the link 63 relative to the rear panel 20. As illustrated schematically in FIG. 3C, the pin 64 may be mounted for some lateral travel relative to the base link 69, and the spring 81 may be connected to the pin 64 and the link 69 to sere two functions. First, the spring 81 will absorb some or all of the compressive forces created when the gate is expanded, and will also consequently limit the maximum outward force that the gate will apply. Second, the spring 81 will bias the linkage 60 towards the unexpanded position shown in FIG. 3B. The spring may alternatively be positioned between the base link 69 and the gate panel 20 with the base link 69 being mounted for lateral movement relative to the rear panel 20.

The operation of the gate is as follows. Initially, the user places the gate within the opening to be blocked, the rear side facing away from where the child or pet will be enclosed. With the knob 73 loosened and the handle link 62 fully raised, the panels 20 and 40 are slidably width adjusted so that the width of the gate is equal to or very slightly less than the width of the opening. Next, the knob 73 is fully tightened to set the unexpanded width of the gate. This unexpanded width will remain set the same until the knob 73 is loosened and accordingly can remain the same over several installation and removal procedures of the gate.

The gate is then inserted into the opening and the handle link 62 is fully depressed, thus expanding the toggle linkage 60 so that the carriage 61 is displaced laterally outwardly relative to the rear panel 20. Since the slider 71 is in engagement with the front panel 40, the front panel 40 is displaced laterally outward relative to the rear panel 20 by a predetermined amount.

As shown in FIG. 3A, the links 62 and 63 rotate slightly over-center after the gate is completely expanded so that it is contracted by a slight amount. That is, the pin 65 (the pivot axis of the connection of links 62 and 63 to each other) is located below a line connecting the threaded rod 72 (the pivot axis of the handle link 62 and the carriage 61) and the pin 64 (the pivot axis of the connections of the pivot link 63 to the rear panel 20 via the base link 69). Due to this over-center rotation, the compressive forces on the gate once installed urge the linkage 60 into the locked position—resulting in an upward pressure being required on the handle link 62 to release the gate, thereby reducing the chances of accidental release of the gate. The amount of over-center travel is limited by contact between the edge 62*c* of the link 62 and an edge 63*c* of the link 63.

When the gate has been expanded inside the opening as described above, it applies an outward lateral force against the sides of the opening. These forces are taken up resiliently in part by compression of the bumpers 29*a*, 29*b*, 49*a* and 49*b*, and in part by compression and/or minor deflection of the panels 20 and 40.

The gate is released by raising the handle link 62, which pulls upward on the center pivot connection 65 of the links 62 and 63 and accordingly also moves the rear panel 20 and the front panel 40 toward each other and releases the pressure on the gate. This permits the gate to be removed from the opening. If the locking knob 73 is not loosened, the gate will be ready for re-insertion into the same opening. If it is desired to use the gate in a different opening, the locking knob 73 is loosened, and the overall width adjustment process is begun as described above.

The mesh panels have elongated holes oriented in the angled directions shown so that the shear stress of the gate caused by outward lateral force acting at the center ridge and the inward lateral forces acting on the bumpers is distributed as tension along the lines of the axes of the slot rather than compression, which orientation helps avoid buckling of the mesh panels.

The gate design described above is advantageous in at least two respects. First, the part of the handle link 62 (the handle grip portion 62*b*) operated by the user is integral with the handle link 62 itself. Second, since the locking knob 73 is located inset into the carriage end of the handle link 62 at the pivot axis of the handle link and the carriage (i.e. the axis of the threaded rod 72), the knob 73 is very conveniently located near the handle grip 62*b* for ease of use. The location of the locking knob 73 in the handle link 62 also helps make the toggle mechanism and engagement mechanism combination laterally compact, and in particular makes the carriage member more compact, thereby realizing a reduction in the potential for buckling or bending of the carriage member.

Although the preferred embodiment has been described above in the context of a gate for blocking a doorway opening, it will be readily appreciated that other applications are possible for the invention. For example, the combination of an over-center linkage having a handle link and a sliding carriage, and/or the combination of an engaging mechanism located on the axis of the pivot axis of the handle link, may be employed with suitable modifications for blocking any opening having side frames such as, for example, a window.

What is claimed is:

1. A pressure-fit barrier for blocking an opening, comprising:

a first panel;

a second panel slidably coupled to said first panel for lateral movement relative thereto;

a linkage having a first handle link having a first end, a second handle end, and a medial portion located between said first and second ends, and a second link having a third end and a fourth end, said third end being pivotally attached to said medial portion, and said linkage being selectively operable between an expanded position in which said first and fourth ends are separated by a first distance and a contracted position in which said first and fourth ends are separated by a second distance less than the first distance, and said fourth end of said linkage being pivotally connected to said second panel;

a carriage member slidably mounted on said second panel for lateral movement relative to said second panel, said first end of said handle link being pivotally coupled to said carriage, wherein operation of said linkage between the contracted position and the expanded position causes lateral movement of said carriage relative to said second panel; and engaging means connected to said carriage and selectively engagable and non-engagable with said first panel, wherein when said engaging means is non-engaged lateral movement of said carriage member does not cause relative lateral movement between said first panel and said second panel, and when said engaging means is engaged lateral movement of said carriage member causes corresponding relative lateral movement between said first panel and said second panel.

2. A pressure-fit barrier for blocking an opening, comprising:

a first panel;

a second panel slidably coupled to said first panel for lateral movement relative thereto;

a base member coupled to said first panel for slidable motion relative thereto;

means for biasing said base member laterally relative to said second panel;

a linkage having a first handle link having a first end, a second handle end, and a medial portion located between said first and second ends, and a second link having a third end and a fourth end, said third end being pivotally attached to said medial portion, and said linkage being selectively operable between an expanded position in which said first and fourth ends are separated by a first distance and a contracted position in which said first and fourth ends are separated by a second distance less than the first distance, and said fourth end of said linkage being pivotally connected to said base member;

a carriage member slidably mounted on said second panel for lateral movement relative to said second panel, said first end of said handle link being pivotally coupled to said carriage, wherein operation of said linkage between the contracted position and the expanded position causes lateral movement of said carriage relative to said second panel; and engaging means connected to said carriage and selectively engagable and non-engagable with said first panel, wherein when said engaging means is non-engaged lateral movement of said carriage member does not cause relative lateral movement between said first panel and said second panel, and when said engaging means is engaged lateral movement of said carriage member causes corresponding relative lateral movement between said first panel and said second panel.

3. A pressure-fit barrier for blocking an opening, comprising:

a first panel;

a second panel slidably coupled to said first panel for lateral movement relative thereto;

a linkage having first and second ends and selectively operable between an expanded position in which said ends are separated by a first distance and a contracted position in which said ends are separated by a second distance less than the first distance, said fourth end of said linkage being pivotally connected to said second panel;

a carriage member slidably mounted on said second panel for lateral movement relative to said second panel, said first end of said handle link being pivotally coupled to said carriage for rotation about a first axis, wherein operation of said linkage between the contracted position and the expanded position causes lateral movement of said carriage relative to said second panel; and engaging means connected to said carriage and selectively engagable and non-engagable with said first panel, said engaging mechanism comprising:

a slider for selectively frictionally engaging said second panel; and a knob having a threaded coupling for coupling said knob to said slider; said knob being located substantially concentric about said first axis, wherein said knob is rotatable to cause said slider to engage said second panel;

wherein when said engaging means is non-engaged lateral movement of said carriage member does not cause relative lateral movement between said first panel and said second panel, and when said engaging means is engaged lateral movement of said carriage member causes corresponding relative lateral movement between said first panel and said second panel.

4. A pressure-fit barrier for blocking an opening, comprising:

a first panel;

a second panel slidably coupled to said first panel for lateral movement relative thereto;

a linkage having a first handle link having a first end, a medial portion, and a second end, and a second link having a third end and a fourth end, said third end being pivotally attached to said medial portion, and said linkage being selectively operable between an expanded position in which said first and fourth ends are separated by a first distance and a contracted position in which said first and fourth ends are separated by a second distance less than the first distance, and said fourth end of said linkage being pivotally connected to said second panel;

a carriage member slidably mounted on said second panel for lateral movement relative to said second panel, said first end of said handle link being pivotally coupled to said carriage, wherein operation of said linkage between the contracted position and the expanded position causes lateral movement of said carriage relative to said second panel; and engaging means connected to said carriage and selectively engagable and non-engagable with said first panel, said engaging means comprising:

a slider for selectively frictionally engaging said second panel; and a knob having a threaded coupling for coupling said knob to said slider; said knob being located substantially concentric about said first axis, wherein said knob is rotatable to cause said slider to engage said second panel;

wherein when said engaging means is non-engaged, lateral movement of said carriage member does not cause relative lateral movement between said first panel and said second panel, and when said engaging means is engaged, lateral movement of said carriage member causes corresponding relative lateral movement between said first panel and said second panel.

5. A pressure-fit barrier for blocking an opening according to claim 4, wherein said second panel has a row of first teeth and said slider has a contact surface defining a row of second teeth that are engagable with said first teeth.

* * * * *